US006000439A

United States Patent [19]

Speich

[11] Patent Number: 6,000,439

[45] Date of Patent: Dec. 14, 1999

[54] MECHANICAL LOOM WITH WARP CHANGING APPARATUS

[75] Inventor: Francisco Speich, Gipf-Oberfrick, Switzerland

[73] Assignee: Textilma AG, Hergiswil, Switzerland

[21] Appl. No.: 09/029,940

[22] PCT Filed: Sep. 8, 1995

[86] PCT No.: PCT/CH95/00199

§ 371 Date: Jul. 16, 1998

§ 102(e) Date: Jul. 16, 1998

[87] PCT Pub. No.: WO97/09478

PCT Pub. Date: Mar. 13, 1997

[51] Int. Cl.[6] ..... D03J 1/00; D03D 49/02

[52] U.S. Cl. ..... 139/1 R; 139/353; 28/208

[58] Field of Search ..... 139/353, 1 R; 28/208, 212

[56] References Cited

U.S. PATENT DOCUMENTS

| | | | |
|---|---|---|---|
| 4,910,837 | 3/1990 | Fujimoto et al. | 139/1 R |
| 4,934,413 | 6/1990 | Yao | 139/1 R |
| 5,050,643 | 9/1991 | Takegawa et al. | 139/353 |
| 5,307,844 | 5/1994 | Gruwez | 139/1 R |
| 5,371,930 | 12/1994 | Lindenmueller et al. | 139/1 R |
| 5,372,164 | 12/1994 | Cloer | 139/97 |
| 5,394,596 | 3/1995 | Lindenulller et al. | 139/1 R |
| 5,657,794 | 8/1997 | Briner et al. | 139/1 R |
| 5,775,380 | 7/1998 | Roelstraete et al. | 139/1 R |

FOREIGN PATENT DOCUMENTS

| | | | |
|---|---|---|---|
| 903 190 | 3/1986 | Belgium | 139/1 R |
| 0 557 752 | 2/1993 | European Pat. Off. | 139/1 R |
| 92 08 800 | 12/1992 | Germany | 139/1 R |
| 2 119 414 | 11/1983 | United Kingdom | 139/1 R |

*Primary Examiner*—Andy Falik
*Attorney, Agent, or Firm*—Brown & Wood, LLP

[57] ABSTRACT

A weaving machine including a machine frame, an apparatus for supplying warp threads, a support apparatus, a plurality of heald frames, a reed, and a replaceable changing apparatus releasably connectable with the machine frame or the support apparatus and including at least one whip roll for deflecting the warp threads, a warp stop motion unit, a holder device for the heald frames and the reed, and at least one apparatus for guiding and/or fixing the warp threads.

17 Claims, 6 Drawing Sheets

MECHANICAL LOOM WITH WARP CHANGING APPARATUS

BACKGROUND OF THE INVENTION

1. Field of the Invention

The invention relates to a weaving machine, in particular a narrow fabric weaving machine, comprising a machine frame, an apparatus for the supply of warp threads, at least one whip roll for the deflection of the warp threads, a support apparatus, a warp stop motion unit, a plurality of heald frames, and a reed.

2. Description of the Prior Art

In order to be able to make a change after the warp and/or the article to be produced has run out, care must be taken that the warp threads do not become mutually entangled. For this reason, it is known, on the one hand, to use a divided weaving machine or to replace the entire weaving machine and, on the other hand, to use a mobile apparatus and/or a storage carriage, with the warp stop motion, the heald frames and the reed generally being taken out and put in together, and with attention being paid to the warp threads remaining taut.

It proves disadvantageous in this respect that the replacement of a weaving machine or of a weaving machine part is laborious and that the whip roll remains in the weaving machine in the case of mobile apparatuses so that measures must be taken in order that the position of the warp threads and the tension in the warp threads is maintained. This means a greater amount of labor for a change of warp and/or article.

For narrow fabric weaving machines an installation apparatus is known by means of which the heddles of the heald frame are stripped off out of the heddle guide rod transverse to the direction in which the band runs and in the horizontal direction in order to perform a change of article. This change is very difficult and laborious to perform. In addition, the time required is considerable.

Accordingly an object of the present invention is to provide a weaving machine in which a change of warp and/or article can be carried out with simplified means and with the lowest time requirement.

SUMMARY OF THE INVENTION

This and other objects of the present invention, which will become apparent hereinafter, are achieved by providing in the weaving machine a changing apparatus having the whip roll, the warp stop motion unit, and a holder device for the heald frames and the reed, with the changing apparatus being coupled to the machine frame or to the support apparatus and being separable from the machine frame or the support apparatus in such manner that in order to carry out a change of an article, the changing apparatus is replaced by another changing apparatus.

Through the collecting together of the warp stop motion unit and the whip roll in the changing apparatus the extension of the warp threads between the warp stop motion and the whip roll is maintained. The change of an article becomes further simplified and temporally shorter due to the fact that a holding means is provided at the changing apparatus for the reception of the heald frames and of the reed.

Through the coupling of the changing apparatus to the support apparatus or to the machine frame, it is possible to merely replace the changing apparatus for a change of article, through which the change of article is simplified and the storage of the changing apparatus in a minimum amount of space is made possible.

Through the combination of the apparatus for supplying the warp threads and of the support apparatus with the changing apparatus to form a change unit, and through the coupling of the change unit to the machine frame the possibilities are provided of either replacing and/or storing the changing apparatus and the apparatus for supplying the warp threads or of merely replacing and/or storing the changing apparatus. Through these replacement possibilities the weaving preparation is further substantially facilitated with respect to a change of warp and/or article.

It proves advantageous if the changing apparatus has a device for the guidance and/or fixing of the warp threads and if the changing apparatus, the heald frames and a drawn-in article are combined to form a storage unit in order to prepare an article for renewed production.

If the heald frames are combined to form a harness, then the time required for the change of article can be further reduced.

If the changing apparatus is provided with a run-in comb, the warp threads, which extend parallel to one another, can be tied off at the run-in comb. A tangling of the warp threads is thereby prevented.

It is advantageous if the apparatus for supplying the warp threads is formed as a frame and if the frame is provided with receiving means for a wound body.

BRIEF DESCRIPTION OF THE DRAWINGS

The invention will be explained in the following with reference to the accompanying drawings.

The drawings show.

DETAILED DESCRIPTION OF THE PREFERRED EMBODIMENTS

Figure 1:
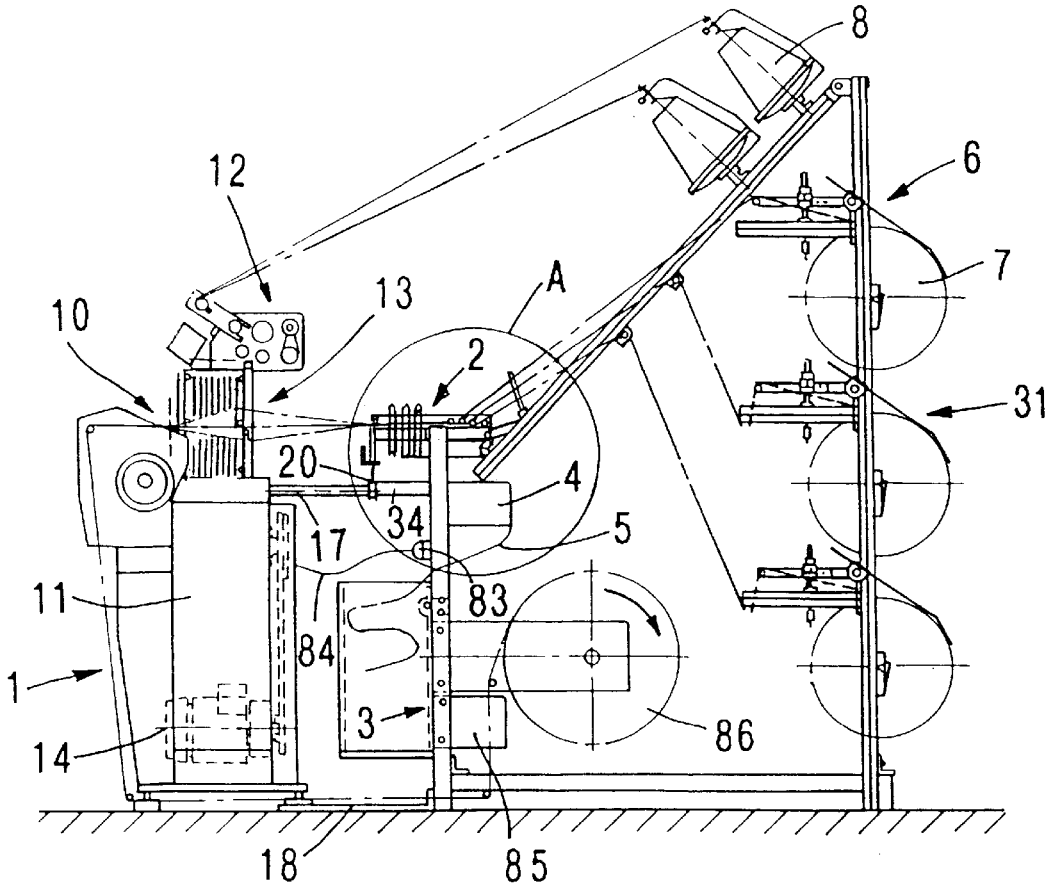
FIG. 1 a side view of an embodiment of a narrow fabric weaving machine in accordance with the invention in the state ready for operation, FIG. 2 a side view of the weaving machine of FIG. 1 in the state ready for a change of article, FIG. 3 a side view of the weaving machine of FIG. 2 after a replacement of the first kind for carrying out a change of an article, FIG. 4 a storage unit for carrying out the replacement of the first kind in section, FIG. 5 a detail "A" in FIG. 1 on a larger scale, FIG. 6 a view in the direction of the arrow "B" in FIG. 5, FIG. 7 a side view of the weaving machine of FIG. 2 for carrying out a replacement of a second kind, FIG. 8 a side view of a change unit for carrying out a change of article through a replacement of the storage unit and FIG. 9 a schematically illustrated broad weaving machine with a second embodiment of a changing apparatus in accordance with the invention.

A first embodiment of the narrow fabric weaving machine consists substantially of a spatially fixed machine part 1, a changing apparatus 2, and a support apparatus 3, with the supply of warp and weft threads being carried out by an autonomous system (not shown). The weaving machine is provided with a rubber transport apparatus 4 which is known per se and with a container 5 for the rubber. The narrow fabric weaving machine can also be equipped with a thermal fixing apparatus 85 and/or with a narrow fabric transport apparatus 86.

A preferred embodiment of the narrow fabric weaving machine has, in addition to the first embodiment, additionally a frame 6 which is connected at two points of separation 21 and 22 to the support apparatus 3 and which is equipped with three warp beams 7 and two weft bobbins 8.

Reference is made to FIGS. 1–8, which show the preferred embodiment of the weaving machine.

Figure 2:
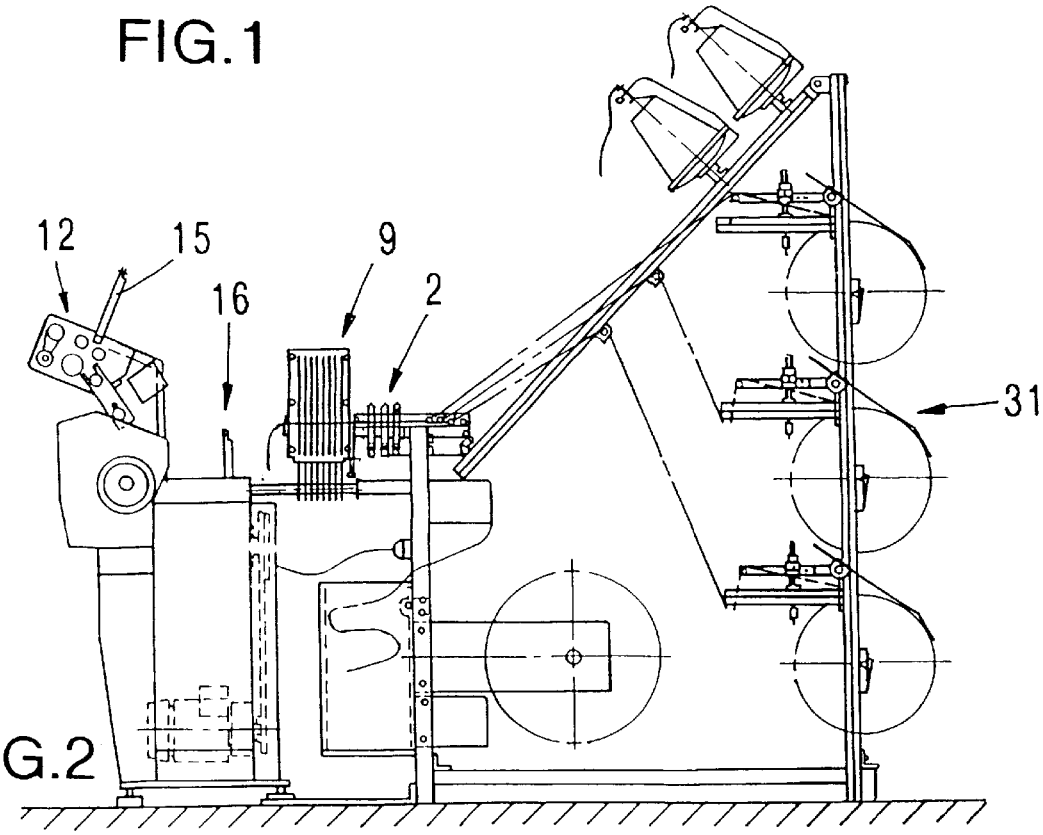

The machine part 1 contains a machine frame 11, an apparatus 12 for the weft thread transport, a non-illustrated weft thread insertion apparatus, a harness 13 and a drive apparatus 14 for the insertion apparatus and the heald frames. The apparatus 12 is pivotally arranged on the machine frame 11 in order to be able to expose the harness and the weft thread transport apparatus. At least one support 15 and 16 is provided at the apparatus 12 and at the machine frame 1 which support the weft thread transport apparatus in the working position and at the same time form a guide for the insertion of the harness (FIG. 2). Furthermore, two bars 17 with abutment buffers 20 and two abutment members 18 are provided at the machine frame 11 in order to orient the frame 6 with respect to the machine part 1 (FIGS. 1 and 5).

Figure 3:
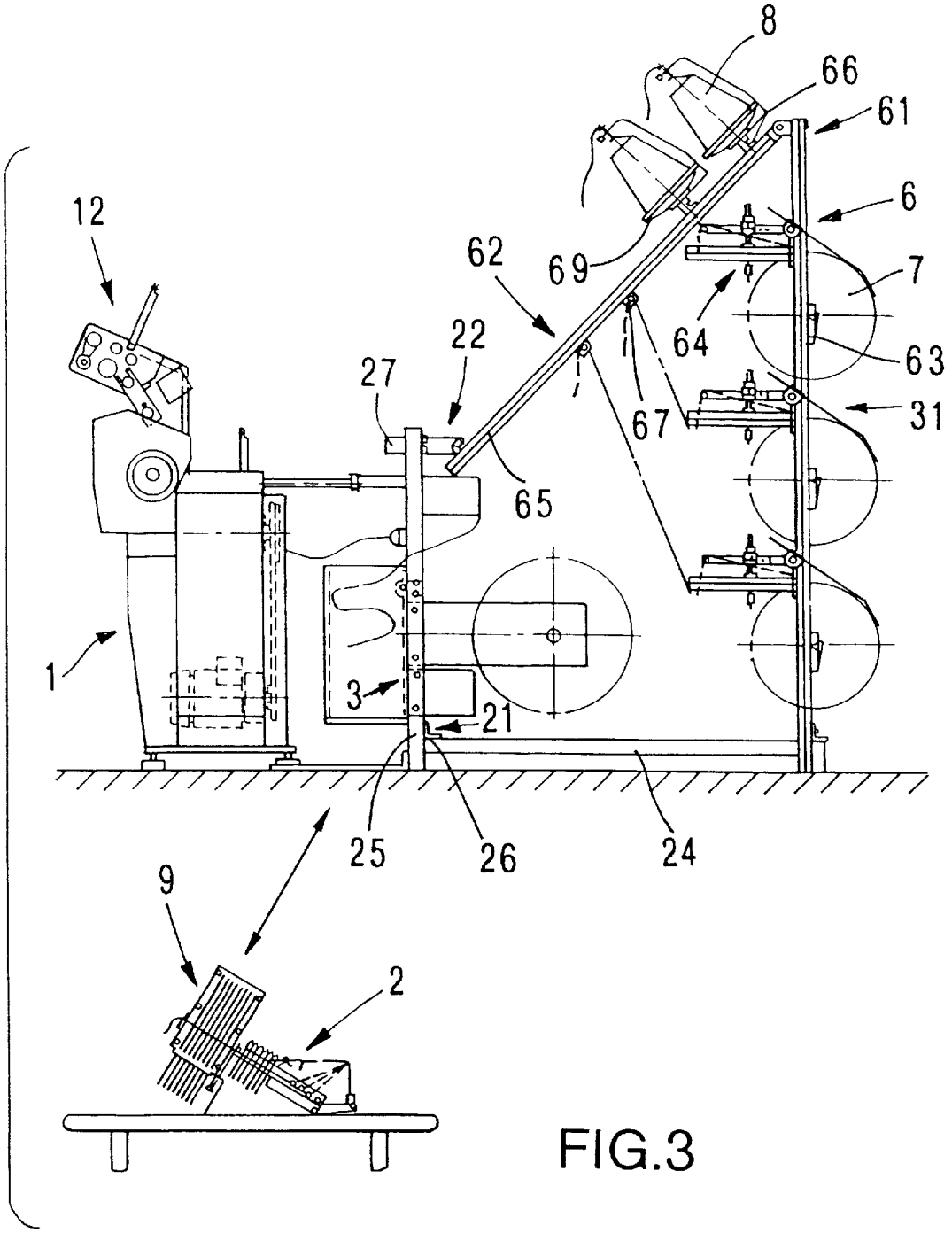
Figure 7:
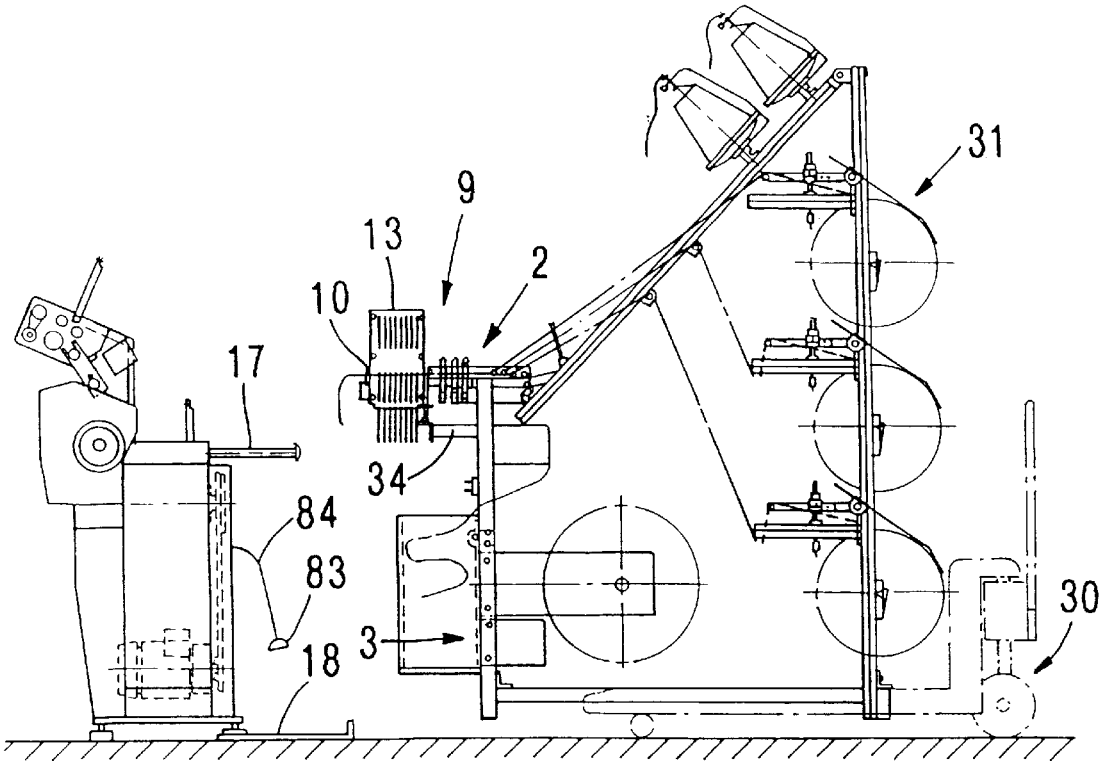
Figure 8:
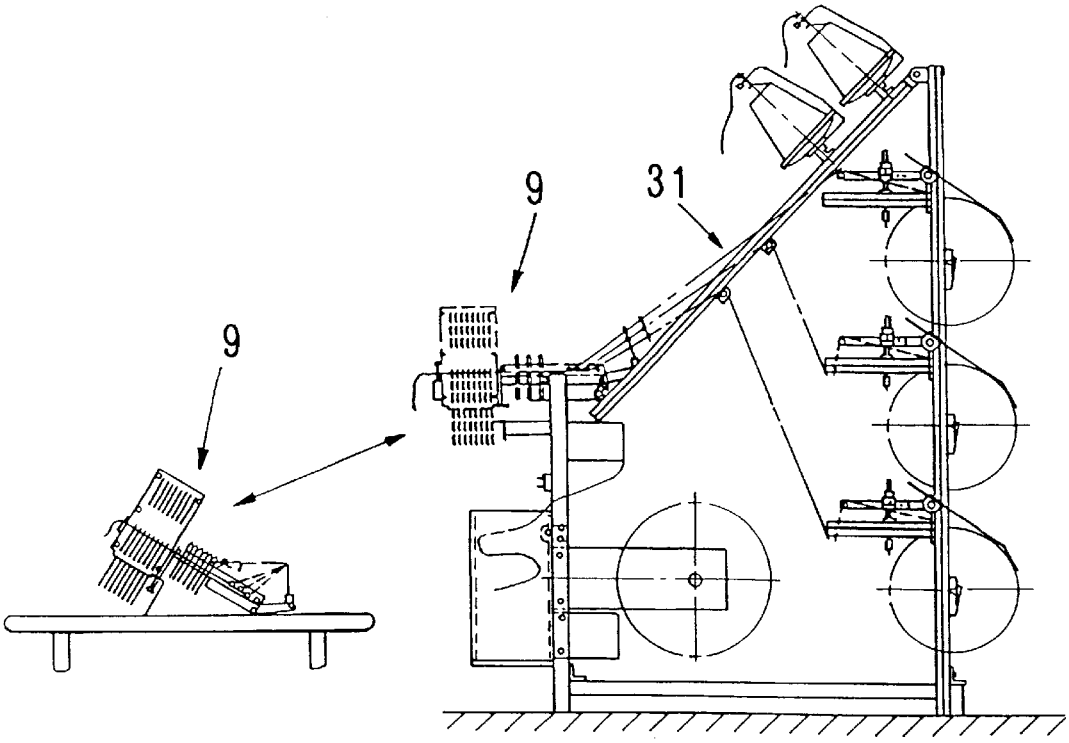

As shown in FIG. 3 the support apparatus 3 and the frame 6 are connected at two points of separation 21, 22 to form a change unit 31 which can be removed from the machine part 1. The support apparatus 3 and the frame 6 are connected via two support rails 24 made of angular section. The support rails 24 are arranged with horizontal limbs directed inwards at a height in order to be able to push a transport carriage 30 under the change unit 31 (FIG. 7). This change unit 31 can be equipped with rollers (not illustrated) which are rotationally movably arranged on the support rails in order to move the change unit.

Figure 6:
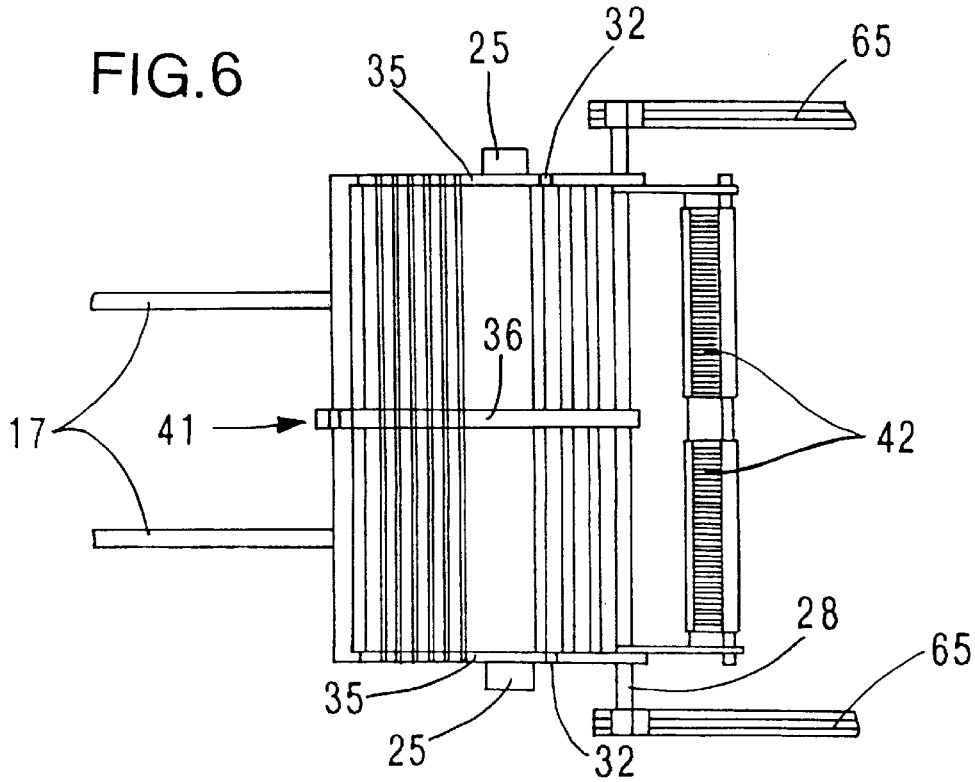

As can be seen in FIG. 3, the support apparatus 3 has two upright struts 25 which are arranged parallel to one another and are connected by a transverse strut 26. Holder rails 27 for receiving the changing apparatus 2 by means of screws 32 are provided at each of the free ends of the struts 25. A round bar 28 is provided which connects the holder grid to the holder rails 27 or to the support apparatus 3 (FIG. 6). Furthermore, the support apparatus 3 has an angle piece 29, which is arranged in such a manner that one limb serves as a support or rest for the changing apparatus 2 and the other limb can be brought into contact with the bar 17 at the machine frame 11 in order to orient the support apparatus 3 with respect to the machine part 1.

Figure 4:
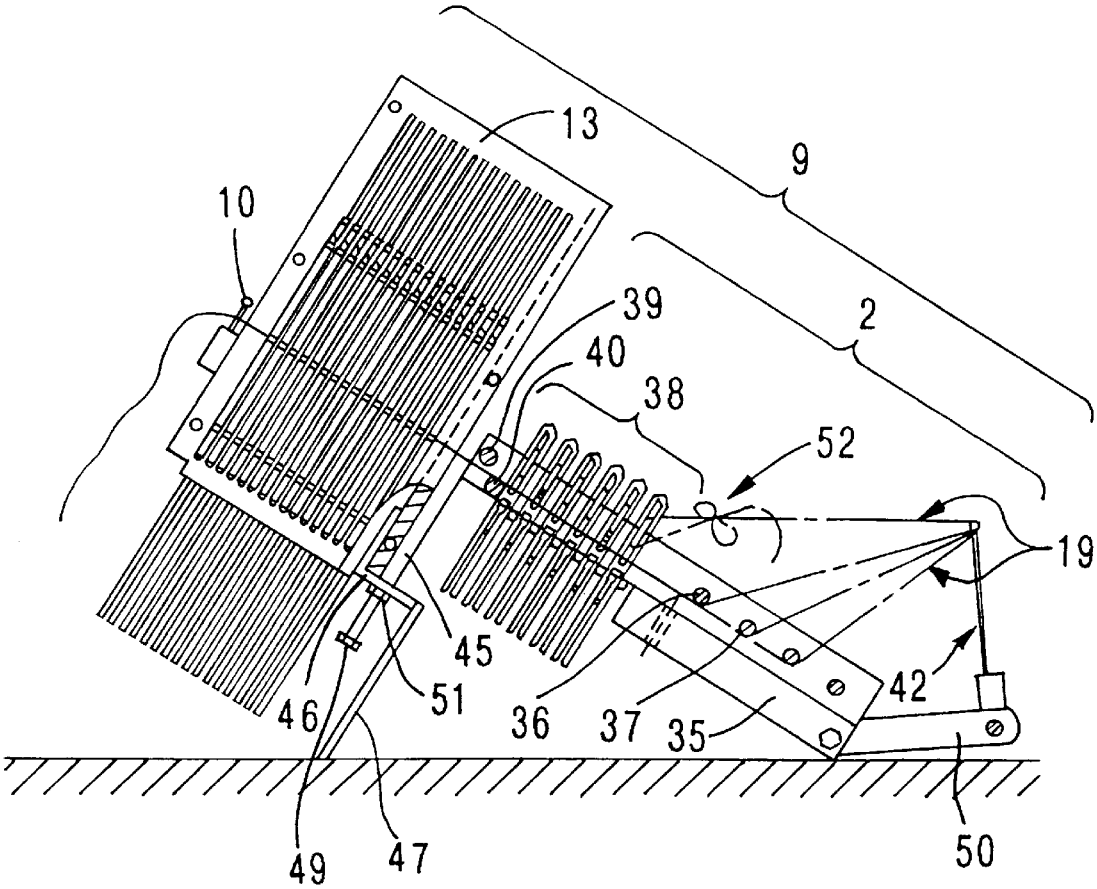
Figure 5:
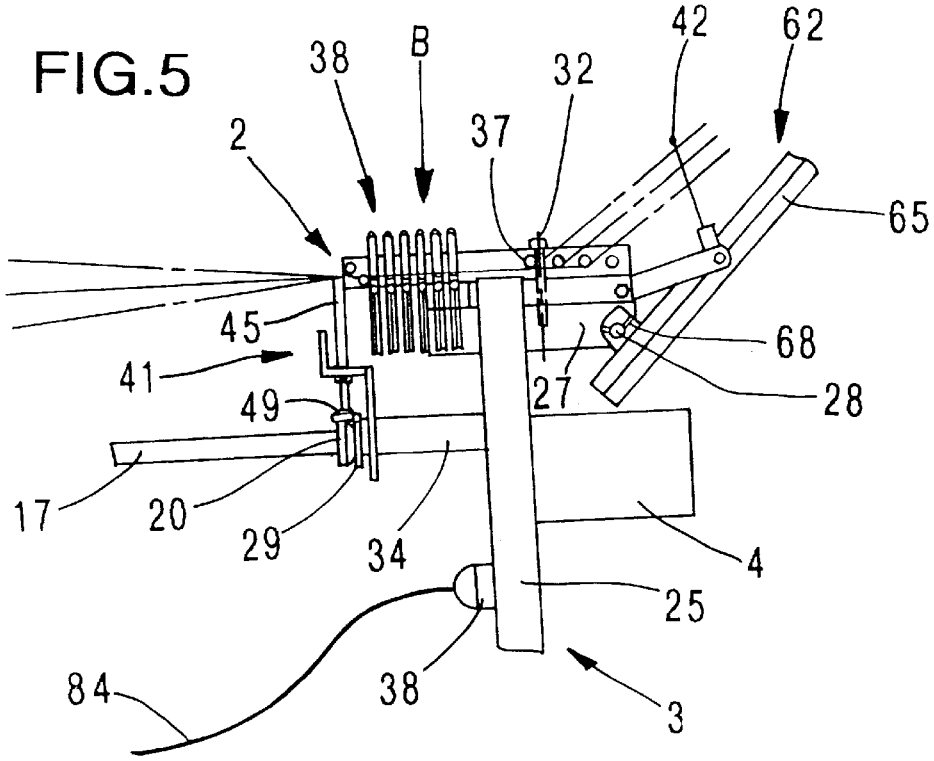

Reference is made to FIGS. 4–6. The changing apparatus 2 contains two side parts 35, a middle part 36, four whip rolls 37, a warp stop motion unit 38 consisting of contact rails and warp stop motion lamella, two guide bars 39, 40 for the warp threads, a holder device 41 for the harness 13 and a warp thread run-in comb 42. The side parts and the middle part are arranged parallel to one another and are connected to the whip rolls and the guide bars in such a manner that a frame is formed. The side parts 35 and the middle part 36 are provided with non-illustrated cut-outs in which the contact rails for the warp stop motion lamella are arranged. Holding means (not illustrated) are provided at each of the side parts 35 and are releasable in order to be able to replace the warp stop motion unit 38.

The holder device 41 comprises a holder 45 which is secured to the middle part 36, an angle 46 which is secured to the holder 45, and a support 47 which is secured to the angle 46 in order to prevent a bending of the heald frames during the storage of the storage unit 9. The angle 46 is secured to the holder 45 by a screw 48 and a nut 51, which serves as a support element for the changing apparatus 2 or the storage unit 9 at the same time.

The warp thread run-in comb 42 is secured via struts 50 to the side parts 35.

The frame 6 contains a holder frame 61 and a holder grid 62. The holder frame 61 is provided with holders 63 for the warp beams 7 and with warp thread let-off devices 64. The holder grid 62 has two side struts 65 which are arranged in parallel and are secured at the one end to the holder frame 61 and at the other end to the holder rails 27 at the support apparatus 3, two transverse struts 66 for the reception of the holder 69 of the weft thread bobbins 8 and two transversely arranged guide bars 67 for the warp threads. The second point of separation 22 is provided between the holder grid 62 and the support apparatus 3. For this, the holder grid 62 is provided with clamping parts 68 in order to secure the holder grid 62 to the bar 28 (FIG. 6). As shown in FIG. 5, an angled section 29 is secured to the centering member 34 in order to support the changing apparatus 2 at the support apparatus 3.

In the weaving machine in accordance with the invention the continuation of the production and the change of article is possible with the renewed production of a previously manufactured article or with the new production of an article.

For the continuation, only the change of the warp bobbins or the weft bobbins and the connection of the warp threads or the insertion of the weft threads need be carried out.

For the renewed production, an article lying in storage is inserted into the machine, changes which may be required in the machine part are carried out, the warp bobbins and the weft bobbins are replaced and the warp and weft threads are connected up.

For the new production of an article the machine part must be re-equipped for the manufacture of the new article. Included in this are e.g. the change of the design warp and of the cam as well as the preparation of the corresponding warp bobbins, the drawing in of the warp threads into the run-in combs, the insertion of the warp stop motion lamella, the drawing in of the warp threads into the heddles of the heald frames and into the reed, and the preparation of the weft bobbins, the insertion of the weft threads into the weft thread transport and insertion apparatus.

In the weaving machine in accordance with the invention the process of changing an article is subdivided into a preparation and into a replacement.

For the preparation of the change of article the fabric or band is separated off ahead of the reed. Afterwards the heald frames are placed into the closed shed position and the frames are released from the drive apparatus. Afterwards the harness is removed from the machine part and suspended in the changing apparatus. Subsequently, the reed is released from the drive apparatus and, while the warp is simultaneously withdrawn, is arranged at the harness which is suspended in the changing apparatus.

In the weaving machine the change of article can be carried out in accordance with the invention by a replacement of components in two ways. In a replacement of the first kind merely a storage unit 9 is replaced and in a replacement of the second kind the change unit 31 with the storage unit 9 is replaced.

In the first embodiment of the weaving machine the changing apparatus 2 is connected to the support apparatus 3 and/or to the machine frame 11. In this weaving machine a change of article is carried out by a replacement of the first kind, with the warp threads of the warp supplied by the autonomous system being separated prior to the replacement and the warp threads being fixed to the run-in comb by knots. The changing apparatus with the drawn-in article is removed from the support apparatus 3 or the machine frame 11 and put in storage as a storage unit 9, as illustrated in FIG. 4. For the renewed production of an article a storage unit 9 with the drawn-in article is inserted into the support apparatus or the machine frame and a new changing apparatus is inserted for the new production.

In the preferred embodiment of the weaving machine the changing apparatus 2 is connected to the change unit 31. In this embodiment the change of article is carried out by a replacement of the second kind (FIG. 7). For the renewed production of an article the storage unit 9 which is provided with the corresponding article is inserted, and for the new production of an article an empty changing apparatus is inserted and the new article is drawn in. This can advantageously be done in a room separate from the weaving hall.

Figure 9:
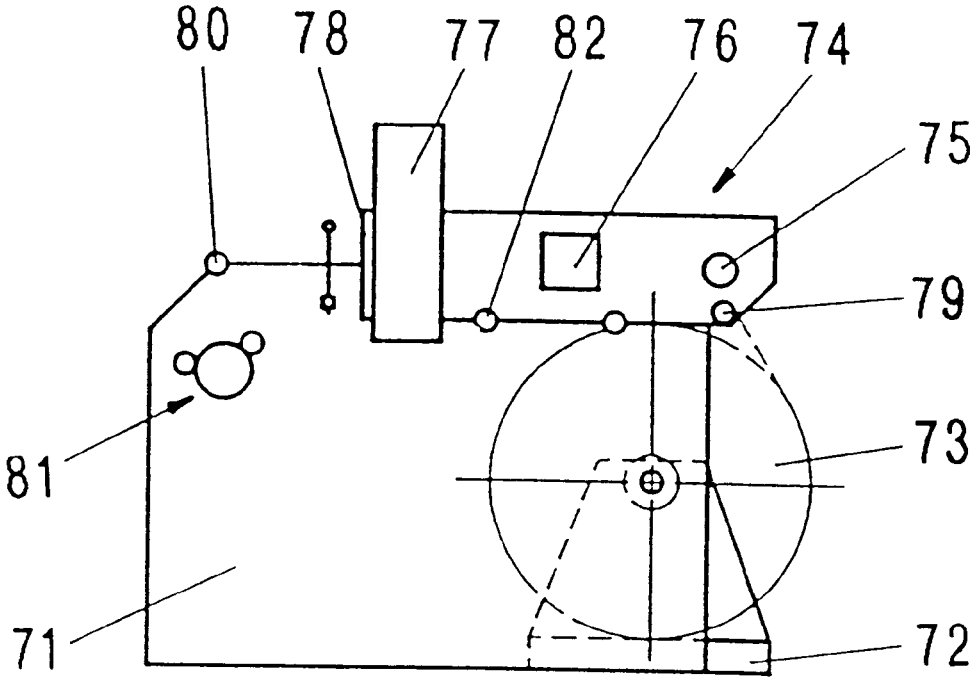

FIG. 9 shows a schematic illustration of a further embodiment of the weaving machine in accordance with the invention. The weaving machine is a broad weaving machine, which has stationary machine part with a machine frame 71, an apparatus 72 for the supply of warp threads with a warp beam 73, a changing apparatus 74, a harness 77 with a number of heald frames, and a reed. The apparatus 72 for supplying warp threads is mobile and can be coupled to the machine frame 71. The changing apparatus has a whip roll 75, a warp stop motion unit 76 and a holder member 78 for the harness 77 and a reed as well as a clamping apparatus 79 for the warp array.

In this embodiment of the weaving machine, a renewed production or a new production of an article can be carried out as described previously.

The weaving machine comprises a machine part 1, a changing apparatus 2, a support apparatus 3 and an apparatus 6 for supplying the warp threads. The changing apparatus contains a whip roll, a warp stop motion unit 38 and a holder apparatus for the heald frames and the reed and is coupled to the machine part 1 or to the support apparatus 3 in such a manner that the changing apparatus 2 with the heald frames, the reed and the drawn-in article is replaceable as a storage unit. Through the combination of the changing apparatus 2 with the apparatus 6 for supplying the warp threads to form a change unit 31, there results a further replacement possibility for a change of article.

It is claimed:

1. A weaving machine, comprising a machine frame; an apparatus for supplying warp threads; a support apparatus; a plurality of heald frames; a reed; a replaceable changing apparatus including at least one whip roll for deflecting the warp threads, a warp stop motion unit, and a holder device for the heald frames and the reed; and means for releasably connecting the changing apparatus with the machine frame, whereby a change of an article is effected, wherein the apparatus for supplying the warp threads is formed as a frame provided with reception means for at least one weft thread bobbin.

2. A weaving machine, comprising a fixed machine part including a machine frame; and apparatus for supplying warp threads; a support apparatus, releasably connected with the fixed machine part; a plurality of heald frames; a reed; a replaceable changing apparatus including at least one whip roll for deflecting the warp threads, a warp stop motion unit, a holder device for the heald frames and the reed, and at least one apparatus for effecting at least one of guiding the warp threads and fixing the warp threads; and means for releasably connecting the changing apparatus with one of the support apparatus and the machine frame, whereby a change of an article is effected.

3. A weaving machine according to claim 2, wherein the warp thread supplying apparatus, the support apparatus and the changing apparatus form a replaceable unit.

4. A weaving machine according to claim 3, wherein the replaceable unit comprises roller means for effecting displacement of the replaceable unit.

5. A weaving machine according to claim 3, wherein the frame comprises centering means for orienting the replaceable unit relative to the frame.

6. A weaving machine according to claim 2, wherein the changing apparatus, together with the heald frames, the reed and the drawn-in article, form a storage unit whereby the article can be prepared for a renewed production.

7. A weaving machine according to claim 2, further comprising a removable harness for receiving the heald frames and having guides for the heald frames.

8. A weaving machine according to claim 2, wherein the changing apparatus is connected with the machine frame.

9. A weaving machine according to claim 2, wherein the changing apparatus is connected to the support apparatus.

10. A weaving machine according to claim 2, wherein the warp threads supplying apparatus comprises a frame having reception means for at least one yarn package.

11. A weaving machine according to claim 10, wherein the at least one yarn package is one of warp cheese and warp beam.

12. A weaving machine according to claim 2, further comprising means provided at least at one of the frame and the support apparatus and adapted to be brought into an engagement with a transport carriage for transporting the at least one of the frame and the support apparatus.

13. A weaving machine according to claim 2, wherein the support apparatus comprises centering means for orienting the support apparatus relative to the frame.

14. A weaving machine according to claim 2, further comprising at least one of rubber transport apparatus, band transport apparatus, and thermal fixing apparatus.

15. A weaving machine according to claim 14, further comprising electrical lead means for connecting the at least one of rubber transport apparatus, band transport apparatus, and thermal fixing apparatus with a source of electrical energy.

16. A weaving machine according to claim 2, further comprising a control system, and electric lead means for connecting the warp stop motion unit with the control system.

17. A weaving machine, comprising a machine frame; an apparatus for supplying warp threads; a support apparatus; a plurality of heald frames; a reed; a replaceable changing apparatus including at least one whip roll for deflecting the warp threads, a warp stop motion unit, a holder device for the heald frames and the reed, and at least one apparatus for effecting at least one of guiding the warp threads and fixing the warp threads; and means for releasably connecting the changing apparatus with one of the support apparatus and the machine frame, whereby a change of an article is effected, wherein the at least one effecting apparatus comprises a warp thread run-in comb.

* * * * *